United States Patent [19]

Kajiwara et al.

[11] Patent Number: 4,963,800

[45] Date of Patent: Oct. 16, 1990

[54] APPARATUS FOR CONTROLLING THROTTLE ACTUATOR

[75] Inventors: Yasuya Kajiwara, Hyogo; Keiu Kawasaki, Giju, both of Japan

[73] Assignee: Mitsubishi Denki Kabushiki Kaisha, Tokyo, Japan

[21] Appl. No.: 365,890

[22] Filed: Jun. 14, 1989

[30] Foreign Application Priority Data

Jun. 14, 1988 [JP] Japan ..... 63-147717

[51] Int. Cl.[5] ..... F02D 41/22

[52] U.S. Cl. ..... 318/254; 318/439; 123/399

[58] Field of Search ..... 318/138, 254, 439, 696; 123/331, 333, 335, 337, 360, 361, 367, 376, 399; 310/68 R, 156

[56] References Cited

U.S. PATENT DOCUMENTS 3,783,357 1/1974 Ichiyanage ..... 318/138
4,698,535 10/1987 Shiraki et al. ..... 310/156

FOREIGN PATENT DOCUMENTS 55-26064 2/1980 Japan ..... 318/254
58-144584 8/1983 Japan ..... 318/254
60-170491 9/1985 Japan ..... 318/254
60-176478 9/1985 Japan ..... 318/439
61-240882 10/1986 Japan ..... 318/254
62-35040 2/1987 Japan .
62-206248 9/1987 Japan .
62-217892 9/1987 Japan ..... 318/254

OTHER PUBLICATIONS

"New Merged Technology Combines Hall Effect Sensors with Intelligence and Power on a Single Chip", Mark F. Heisig, pp. 31-36.

*Primary Examiner*—Bentsu Ro

*Attorney, Agent, or Firm*—Sughrue, Mion, Zinn, Macpeak and Seas

[57] ABSTRACT

There is provided an apparatus for controlling a throttle actuator which detects the magnetic pole position of a rotor of a brushless motor connected to a throttle valve and drives the brushless motor in response to the detected magnetic pole position detecting signal. The apparatus is arranged to detect any fault in the magnetic pole position detecting signal and steppingly drive the brushless motor independently of the magnetic pole position detecting signal when a fault is detected.

5 Claims, 2 Drawing Sheets

APPARATUS FOR CONTROLLING THROTTLE ACTUATOR

BACKGROUND OF THE INVENTION

1. Field of the Invention

This invention generally relates to an apparatus for controlling a throttle actuator which drives a throttle valve provided in a suction pipe of an internal combustion engine installed in an automobile or the like and, more particularly, to an apparatus that utilizes a brushless motor for the throttle actuator.

2. Description of the Prior Art

As disclosed in Japanese Patent Public Disclosure (Kokai) No. 35040/1987, it has previously been the practice to utilize a stepping motor as the motor of such throttle actuators. FIG. 1 shows such a conventional apparatus which comprises an accelerator pedal 21, an accelerator pedal sensor 22 for sensing the degree of depression of the pedal 21 and a throttle valve control circuit 23 including an analog-to-digital (A/D) converter 23A, a central processing unit (CPU) 23B, and a latch 23C. The apparatus further includes a motor driver 24 adapted to receive a drive control rate signal from the latch 23C, a stepping motor 25 driven by the motor driver 24 to control the degree of opening of a throttle valve 26, a return spring 26a for the throttle valve 26, and a throttle opening sensor 27 for sensing the degree of opening of the throttle valve 26, the sensor 27 being connected to the A/D converter 23A.

The operation of this conventional apparatus will be described below. An output signal from the accelerator pedal sensor 22 which is of a magnitude corresponding to the degree of depression of the accelerator pedal 21 is read by the throttle valve control circuit 23 which, in turn, produces a driving control signal in response thereto and feeds it to the motor driver 24 to drive the stepping motor 25. Thus, the motor driver 24 drives the stepping motor 25 in accordance with the driving control signal to adjust the opening of the throttle valve 26. The degree of opening of the throttle valve 26 is detected by the throttle opening sensor 27 and fed back to the throttle valve control circuit 23 to determine whether or not a predetermined degree of opening has been established.

It is advisable to substitute a brushless motor for the above-mentioned stepping motor 25, because the latter usually has a relatively low operating speed, a relatively high degree of vibration, or a relatively low level of motor efficiency. The brushless motor is operated in such a manner that the magnetic poles of the rotor are detected by means of an electronic circuit, instead of using the brushes of a direct current motor, and changing the current to the stator windings in accordance with the detected signal. Japanese Patent Public Disclosure (Kokai) No. 206248/1987 discloses a method of eliminating the circuit for detecting the position of the magnetic poles, but such a method is useless when the rotor is not rotated, that is, upon starting.

A conventional apparatus for controlling a throttle actuator uses an electronic circuit to detect the magnetic poles of the rotor of the brushless motor and therefore involves drawbacks in that, if any fault occurs in the magnetic pole position detection circuit such as to produce an abnormal magnetic pole position detection signal, the brushless motor may stop, which would result in the control of the throttle valve operation not being performed.

SUMMARY OF THE INVENTION

The present invention has been accomplished with a view to solving the above-mentioned problems of the prior art by providing an apparatus for controlling a throttle actuator in which even if the magnetic pole position detecting signal becomes abnormal, the brushless motor is rotated normally to achieve the opening and closing of the throttle valve.

According to the present invention, there is provided an apparatus for controlling a throttle actuator comprising a fault detecting means for detecting any abnormality of the magnetic pole position detecting signal and a means for steppingly driving the brushless motor irrespective of the magnetic pole position detecting signal when a fault occurs.

The apparatus of the invention is operated in such a manner that motor is driven in response to the magnetic pole position detecting signal during its normal operation, and when an abnormality is detected in the magnetic pole position detecting signal, the apparatus drives the brushless motor independently of such signal in step-by-step fashion.

DETAILED DESCRIPTION OF THE PREFERRED EMBODIMENTS

Figure 1:
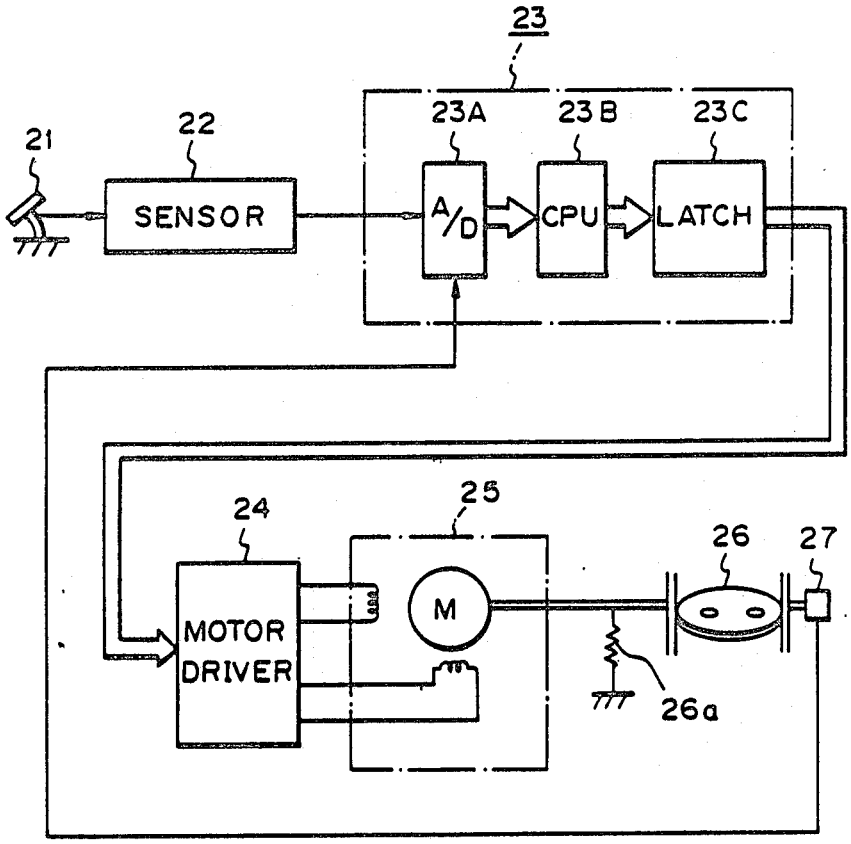
Fig. 1 (PRIOR ART)
FIG. 1 is a schematical representation of a conventional apparatus.
Figure 2:
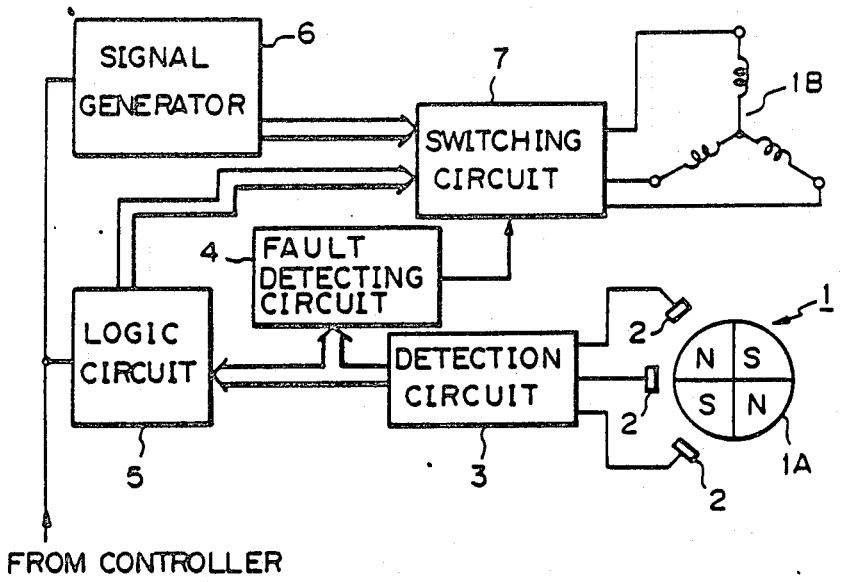
FIG. 2 is a schematical representation of an apparatus for controlling a throttle actuator in accordance with an embodiment of the present invention.

An embodiment of the present invention will now be described in detail. FIG. 2 schematically shows an apparatus for controlling a throttle actuator in accordance with an embodiment of the invention. In FIG. 2, a three-phase brushless motor 1 comprises a rotor 1A having four magnetic poles consisting of alternately disposed north (N) poles and south (S) poles and a three-phase stator winding 1B, the shaft of the motor being connected to a throttle valve (not shown) to allow opening and closing operations thereof to be carried out. There are also three magnetic pole detecting elements 2 disposed circumferentially along and adjacent to the rotor 1A and adapted to detect the position of the magnetic poles, and a detection circuit 3 connected at its input end to these elements 2. The detection circuit 3 functions in cooperation with the elements 2 as a magnetic pole position detecting circuit, as well as shaping the waveform of input signals. A fault detecting circuit 4 detects any fault in the magnetic pole position detecting circuit in accordance with a magnetic pole position detecting signal from the detection circuit 3. A logic circuit 5, in response to the magnetic pole position detecting signal, generates a signal to the brushless motor 1 to rotate. A signal generator 6 generates a signal to the brushless motor 1 to rotate irrespective of said magnetic pole position detecting signal. The signals from the signal generator 6 and the logic circuit 5 serve to cause the brushless motor 1 to rotate in the normal or reverse directions, or to stop in accordance with a command signal from a controller (not shown). A switching circuit 7 is connected to the stator winding 1B of the brushless motor 1 to select one of the output signals of the logic circuit 5 and signal generator 6 in response to the output signal of the fault detecting circuit 4 and to drive the brushless motor 1 on the basis of the selected signal.

The operation will be described below by reference to FIG. 2. The position of the magnetic poles of the rotor 1A is detected by the magnetic pole detecting elements 2. The output signals of the three magnetic pole detecting elements 2 are wave-shaped by the detection circuit 3 and then converted to signals which are fed to the fault detecting circuit 4 which is designed to detect the presence of any fault and to the logic circuit 5 which serves to rotate the brushless motor 1.

During the normal operation of the magnetic pole position detecting circuit constructed of the magnetic pole detecting elements 2 and the detection circuit 3 for detecting the magnetic pole position of the rotor 1A, the fault detecting circuit 4 outputs a signal indicative of the normal operation. In response to the normal signal, the signal switching circuit 7 energizes the brushless motor 1 with the signal from the logic circuit 5 in accordance with the command from the controller. If said magnetic pole position detecting circuit indicates an abnormal operation, the fault detecting circuit 4 detects the presence of a fault from the abnormality indicated by the magnetic pole position detecting signal from the detection circuit 3, thereby outputting a fault detection signal. In response to this fault detection signal, the signal switching circuit 7 provides the stator windings 1B with pulses so that the brushless motor 1 is steppingly rotated with the pulse signals from the signal generator 6 in accordance with the command of the controller. The throttle valve is opened or closed as the brushless motor 1 rotates.

Figure 3:
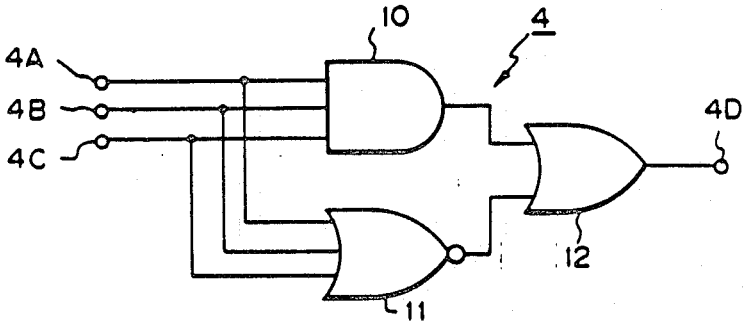
FIG. 3 is a circuit diagram of an example of the fault detecting circuit of the apparatus of FIG. 2.

An example of the fault detecting circuit 4 will be described below in greater detail by reference to FIG. 3. In FIG. 3, three input terminals 4A–4C are common to AND circuit 10 and NOR circuit 11, and an output terminal 4D provides an output signal from OR circuit 12 which functions to output the logical sum of the outputs of the AND circuit 10 and NOR circuit 11. The magnetic pole position detecting signals are three high or low logic signals, and so long as the magnetic pole position detecting circuit is operating normally, the three signals applied to the input terminals 4A–4C will not all be simultaneously high or low. Thus the output of the AND circuit 10 is low because one of the three input signals is logically low at any one time, and the output of the NOR circuit 11 is low because one of the three input signals is logically high at any one time, and the signal supplied from the OR circuit 12 to the output terminal 4D is usually low. If any fault or trouble is caused in said magnetic pole position detecting circuit, for example, If any one of the three-line signals is fixed at high, all the three-line signals may become high. If one-line signal is erroneously fixed at low, the three-line signals may all become low, and is a signal or signals changes irregularly between high and low because of unstable high and low shifts due to an imperfect contact or the like, the three-line signals may all become high or low.

In the example of the fault detecting circuit 4 shown in FIG. 3, when the three input terminals 4A–4C become high, the output of the AND circuit 10 becomes high and the output terminal 4D becomes high through the OR circuit 12. When the three input terminals 4A–4C become low, the output of the NOR circuit 11 becomes high and the output terminal 4D becomes high. In this manner, when the magnetic pole position detecting circuit is in its normal condition, the output of the fault detecting circuit 4 is a normal signal of logical low, but when a fault occurs it becomes a fault detecting signal of logical high.

Such fault detecting signal is not kept high during the occurrence of a fault in said magnetic pole position detecting circuit, but is detected and supplied in a pulse-like fashion, and it is therefore necessary to latch the fault detecting signal. Since such fault may take place instantaneously due to an imperfect contact, however, it may be appropriate to count the number of such fault detecting signals and to latch them at a time when the count reaches a predetermined number. It may also be possible to clear the latched fault detecting signals upon turning off the power supply.

Although the above-described embodiment is arranged to perform all the operations with hardware, it may be possible to arrange it in such a manner that at least part of the functions of the hardware are provided as software in a microcomputer, the detection, counting, determination and so on of the fault detecting signals being performed by the microcomputer, the driving signal switched by the command from the microcomputer, and the signal for driving the brushless motor steppingly supplied directly from the microcomputer. Such an arrangement provides certain advantages in that the number of hardware parts is reduced and a compact structure can be obtained.

From the foregoing, it will be appreciated that the present invention provides an arrangement in which when a fault is detected in the magnetic pole position detecting signal, the brushless motor is steppingly driven independently of the magnetic pole position detecting signal, thereby providing the meritorious effect that the brushless motor can be maintained in normal rotation even when the magnetic pole position detecting signal becomes abnormal, and enhanced reliability of the throttle actuator can thus be established.

Having described a preferred embodiment of the invention, it will be apparent to those skilled in the art that many changes and modifications may be made without departing from the concepts of the invention.

What is claimed is:

1. In an apparatus for controlling a throttle actuator, including means for detecting the magnetic pole position of a rotor of a brushless motor connected to a throttle valve and means for driving said brushless motor in response to the magnetic pole position detecting means, the improvement comprising:

a fault detecting means for detecting any fault in said magnetic pole position detecting means; and means responsive to said fault detecting means for steppingly driving said brushless motor independently of said magnetic pole position detecting means when a fault is detected.

2. An apparatus for controlling a throttle actuator comprising:

means (2,3) for detecting the position of a plurality of megnetic poles of a rotor (1) of a brushless motor and providing a magnetic pole position signal;

a first signal generating means (5) for generating pulses to drive a stator winding of said brushless motor in accordance with the magnetic pole position signal provided by said detecting means;

a second signal generating means (6) for generating pulse to drive the stator winding independently of said first signal generating means;

means (4) for determining whether or not said magnetic pole position signal is normal; and a switching means (7) responsive to said determining means for selecting one of said first signal generating means and said second signal generating means to drive the stator winding.

3. The apparatus as recited in claim 2 wherein:

said detecting means comprises three magnetic pole detecting elements.

4. The apparatus as recited in claim 3 wherein:

said determining means finds a fault when output signals of the three magnetic pole detecting elements are substantially the same.

5. The apparatus as recited in claim 4, wherein said determining means comprises a first logic element (10) for detecting that all of the magnetic pole detecting elements output signals are at a high level, a second logic element (11) for detecting that all of the magnetic pole detecting elements output signals are at a low level, and means (12) responsive to an output from either the first or the second logic element for producing a fault signal.

* * * * *